United States Patent [19]

Kiefer et al.

[11] 4,188,892

[45] Feb. 19, 1980

[54] METHOD AND APPARATUS FOR REMOVAL OF FLY ASH FROM A WASTE INCINERATOR WITH LIQUID SLAG DISCHARGE

[75] Inventors: Gerhard Kiefer, Adliswil; Pierre Kurt, Langnau, both of Switzerland

[73] Assignee: Von Roll AG, Gerlafingen, Switzerland

[21] Appl. No.: 890,927

[22] Filed: Mar. 28, 1978

[30] Foreign Application Priority Data

Apr. 6, 1977 [CH] Switzerland ..... 4397/77

[51] Int. Cl.[2] ..... F23G 7/00

[52] U.S. Cl. ..... 110/238; 110/213; 110/246; 110/119

[58] Field of Search ..... 110/266, 238, 246, 216, 110/119, 243

[56] References Cited

U.S. PATENT DOCUMENTS

| | | | |
|---|---|---|---|
| 1,970,109 | 8/1934 | Stratton | 110/266 |
| 2,917,011 | 12/1959 | Korner | 110/266 |
| 3,417,717 | 12/1968 | Jacobovici | 110/243 |
| 3,592,151 | 7/1971 | Webber | 110/243 |
| 4,027,602 | 6/1977 | Mott | 110/243 |

*Primary Examiner*—Kenneth W. Sprague
*Attorney, Agent, or Firm*—Weingarten, Maxham & Schurgin

[57] ABSTRACT

After the fly ash is removed from the flue gases by a separator, it is introduced into a combustion chamber which may be either the primary combustion chamber of the furnace or a separate chamber in a secondary combustion chamber. There, it is burned until only the liquid slag remains and then removed, along with the other liquid slag formed in the furnace by the primary combustion process. Various methods and apparatus are described for carrying out the introduction of the fly ash into the combustion chamber. They include: packing the fly ash into separate metal containers to be introduced into a rotating primary combustion chamber of the furnace; mixing the ash with fuel and introducing it into the furnace through a lance; forming the ash into pellets and introducing the pellets into the furnace; blowing the ash through an air lance into the output end of the furnace and into the molten slag therein; and, blowing the ash through an air lance into a separate combustion chamber in the secondary combustion chamber of the incinerator.

20 Claims, 4 Drawing Figures

1
2
3
3a
3b
4
5
6
7
8
9
10
11
12
13
14
15
16
17
18
19
20
21
22
23
24
25
33
37
39
40

METHOD AND APPARATUS FOR REMOVAL OF FLY ASH FROM A WASTE INCINERATOR WITH LIQUID SLAG DISCHARGE

BACKGROUND OF THE INVENTION

The invention relates to a method for the treatment of fly ash in a waste incinerating plant with liquid slag discharge, comprising a revolving cylindrical furnace provided with charging equipment for solid, pasty and liquid waste materials as well as sludge and which at its end has a melting slag bath, a secondary combustion chamber, and a flue gas dust separator, whereby the fly ash separated from the flue gases by means of the latter is discharged together with the slag by means of the incinerator slag discharge system.

The invention also relates to a plant for performing this method.

In order to avoid atmospheric pollution, particular importance is attached to removing dust from flue gases when burning waste materials which are rich in ballast. Whereas, when removing the dust from flue gases by means of electrostatic filters, cyclones or cloth and/or tube filters the separated dust is discharged in the dry state. When using a gas scrubber this leads to a wet dust discharge in the form of sludge. The present invention is in particular based on so-called dry flue gas dust separation.

Herein the dust separated by a flue gas dust separator is called "fly ash", whereas the dust still carried by the flue gases downstream of the gas dust separator and which finally pass through the chimney into the atmosphere is called "flue dust".

If the fly ash is discharged dry from a waste incinerator, it is in known manner stored under field conditions, either separately or together with the slag.

As is known, the composition of fly ash differs considerably from the composition of slag from municipal refuse incinerators and the composition of slag from industrial refuse incinerators which has been melted in a revolving cylindrical furnace. The following table of approximate compositions illustrates these differences:

| Part | | Fly ash | Slag from: communal refuse incinerators | Slag from: industrial refuse incinerators |
|---|---|---|---|---|
| Combustible | (% by weight) | 5–10 | 2–6 | 0–2 |
| Ash | (% by weight) | 90–95 | 94–98 | 98–100 |
| Soluble part | (% by weight) | 20–50 | approx. 1 | 1–3 |

The proportion of easily volatized heavy metals, such as e.g. zinc, manganese, or lead is many times higher in the fly ash than in the slag, while the melting point of the fly ash is generally lower than that of the slag. The water absorption capacity of molten slag is approx. 1 to 2% by weight.

In a known method of fly ash removal, the slag, together with the admixed fly ash, is dumped under field conditions. However, the fly ash, which contains in addition to its unburned organic constituents also a large proportion of water-soluble substances, as well as easily volatized heavy metals, such as e.g. tin, manganese, lead, etc. (cf. above table) can cause a contamination of the soil and the ground water. In addition, the transportation of the slag to a dump and the storage thereof in the latter can cause serious dust pollution of the surrounding atmosphere.

SUMMARY OF THE INVENTION

According to the present invention, the separated fly ash is initially conveyed into a storage tank and from the latter to a revolving cylindrical furnace or to an additional melting chamber which is also provided with a molten bath arranged in the secondary combustion chamber. The combustible constituent still contained in the fly ash is then burnt. The fly ash is melted in the molten bath and the molten fly ash is fed into the wet slag removal plant, from where it is removed with the slag via the slag discharge system.

The invention also relates to a plant for performing the method, wherein there is provided a fly ash conveying mechanism connecting the discharge side of the fly ash separator with the storage tank and at least one charging mechanism which also serves to feed the fly ash into the revolving, cylindrical furnace provided at the front wall of the furnace or a charging lance for the fly ash which extends into the revolving cylindrical furnace or the additional melting chamber and which is directed onto the molten bath located therein.

BRIEF DESCRIPTION OF THE DRAWINGS

Five embodiments of the invention are explained hereinafter relative to the drawings. The drawings diagrammatically illustrate embodiments of a plant according to the present invention.

DETAILED DESCRIPTION OF THE PREFERRED EMBODIMENTS

Figures 1, 2:
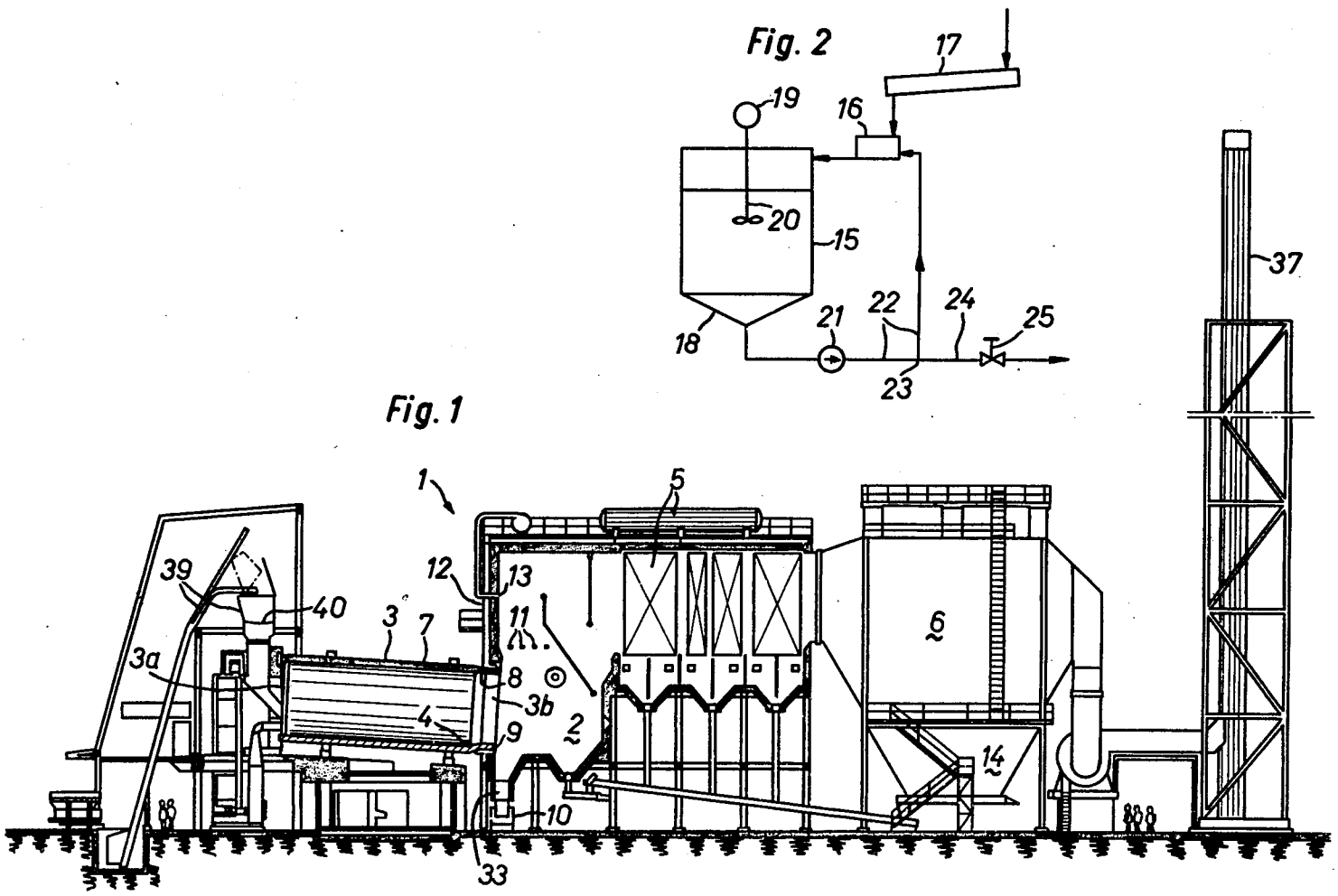
FIG. 1 shows a waste incinerating plant in accordance with a preferred embodiment of the present invention in a vertical longitudinal section.
FIG. 2 shows schematically a part of the plant of FIG. 1 for mixing the fly ash with liquid waste fuels or sludge prior to feeding it into the revolving cylindrical furnace of the plant of FIG. 1 in a flow diagram (second embodiment).
Figure 4:
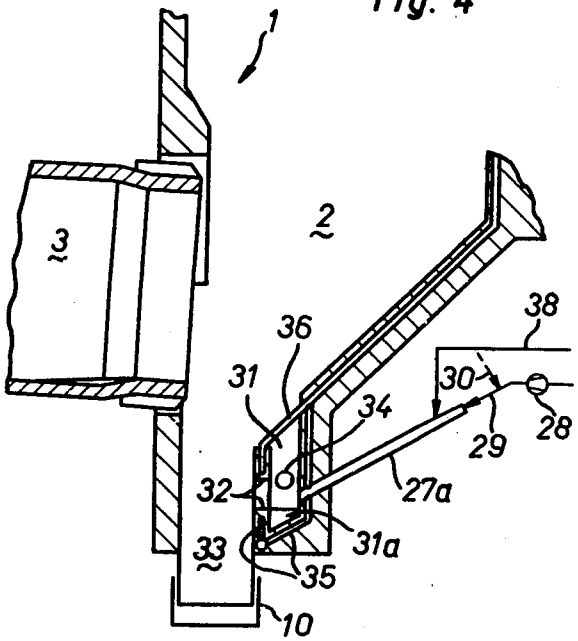
FIG. 4 shows a fragment section of the rear part of a plant, like that of FIG. 1, but with an additional melting chamber in its secondary combustion chamber (fifth embodiment).

FIG. 1 shows a waste incinerating plant fundamentally suitable for performing the method according to all five embodiments and designated by the reference numeral 1, whereby its secondary combustion chamber 2 is further developed in the manner described relative to FIG. 4 for performing the fifth embodiment.

The plant 1 according to FIG. 1 features a revolving cylindrical furnace 3 on whose front wall 3*a* are provided charging mechanisms for the furnace and on whose inwardly bent end 3*b* a molten slag bath 4 is provided within the furnace, together with the above-mentioned secondary combustion chamber 2, a boiler 5 connected thereto, a following apparatus 6 for dry flue gas dust separation, e.g. in the form of an electrostatic filter, optionally an apparatus for separating gaseous harmful substances from the flue gases from which the dust has been removed (not shown in FIG. 1) and a following chimney 37.

Pasty and solid waste materials in metal tanks are fed into the revolving cylindrical furnace 3 by means of a charging mechanism 39 equipped with a cap 40 and located on the furnace front wall 3*a*. Liquid waste material and sludge are also fed into the revolving cylindrical furnace 3 by means of a plurality of so-called fuel lances which are also arranged on the furnace front wall 3*a*. A supporting and pilot burner, e.g. operated with waste oil is also fitted on the furnace front wall 3*a*.

Due to the continuous revolving movement of furnace 3, the waste materials are transported to the rear end 3*b* thereof, in the course of which they ignite and gradually burn out. Due to the high temperature and the special construction of the revolving furnace shell 7 with an inwardly directed shell bend 8, the molten slag bath 4, which continuously overflows towards the rear edge 9 is formed at the rear end 3*b* of the revolving cylindrical furnace 3. The molten slag leaving furnace 3 drops through a slag shaft 33 into a wet slag removing apparatus 10, wherein it is quenched by water. The wet slag removing apparatus 10 also contains an endless scraper chain guided over rollers, by means of which the solidified slag can be discharged from the waste incinerating plant 1.

The necessary combustion air is fed into the revolving cylindrical furnace 3 as primary air by means of a blower provided on furnace front wall 3*a*. The dust-charged flue gases flow out of furnace 3 into secondary combustion chamber 2, in which they are completely burned with secondary air supplied by means of side wall nozzles 11. In the subsequently connected boiler 5, heat is removed from the flue gases. In the following dust separator 6, which can here be in the form of an electrostatic filter, the dust is separated in dry form from the flue gases and is discharged from the hopper 14 located beneath the same. If necessary, harmful gases contained in the flue gases can be separated in a wet scrubber, not shown, connected behind the dust separator 6.

1st Embodiment

In the plant according to FIG. 1 the fly ash is supplied from hopper 14 of dust separator 6 to a storage tank by means of a conveying mechanism which is not shown in FIG. 1. Depending on the size of the plant, the fly ash is fed either manually or automatically from the storage tank into metal containers. The filled containers are sealed with a sheet metal lid which, to avoid internal overpressures or explosions, is provided with at least one vent. The metal containers filled with fly ash in this way are introduced into the revolving cylindrical furnace 3 by means of the charging mechanism for solid waste arranged on furnace front wall 3*a*, together with said solid waste. The sealed metal containers pass through the furnace 3 up to the molten slag bath 4 arranged at its rear end 3*b*. Any still unburned combustible fly ash is thereby substantially completely burned. When they reach the molten slag bath 4 the metal containers melt. Since the melting temperature of the fly ash is lower than that of the metal casing container, when the latter melts, its content, i.e. the fly ash, is already in a pasty or even liquid state. As a result, no finely divided ash particles from the content are entrained by the flue gas flow passing over the molten slag bath 4 into secondary combustion chamber 2 and the following plant units (boiler 5, dust separator 6).

2nd Embodiment

According to FIG. 2 in the plant of FIG. 1, the fly ash is fed by means of a conveying mechanism from the storage tank connected to hopper 14 of the flue gas dust separator by means of a feed mechanism into a container 15 for liquid waste or sludge with a fitted mixing device 16, the fly ash being simultaneously cooled. The fly ash supplied from above via a proportioning worm 17 is mixed with the waste fuels or sludge carried in the fuel circuit via container 15 by mixing device 16. To prevent fly ash from being deposited on the bottom 18 of the container 15, the content of the latter is kept continuously in motion by means of a stirring impeller 20 driven by a motor 19. A partial flow of the mixture formed from the waste fuel or industrial sludge and the fly ash which is circulated by means of a circulating pump 21 through a pipe 22 over mixing device 16 and container 15 is branched off from the circuit at a point 23 and is fed into the revolving cylindrical furnace 3 through a pipe 24, in a quantity controlled by a regulating valve 25, by means of the fuel lance for liquid waste or sludge located on the front wall 3*a* of furnace 3 (cf. FIG. 1) and therein burned. The resulting slag is melted again in the molten slag bath 4 provided at the rear end 3*b* of furnace 3 (cf. FIG. 1).

3rd Embodiment

In a third embodiment of the present invention, the fly ash is supplied from a storage tank connected by means of a feed mechanism to the hopper 14 of the flue gas dust separator 6 (cf. FIG. 1) via a proportioning worm to a pelletizer and after the addition of water and binders is processed therein to form a coarse-grained material or pellets. These pellets are placed in open containers and are introduced into the revolving cylindrical furnace 3 by means of the charging mechanism located on the front wall 3*a* of furnace 3 for solid waste and barrels or tanks or by means of a special charging port provided especially for feeding in pellets. The pellets pass through the revolving cylindrical furnace 3 together with the solid and/or liquid waste, whereby they ignite and burn, their slag finally being melted in the molten slag bath 4 located at end 3*b* of the furnace 3.

4th Embodiment

Figure 3:
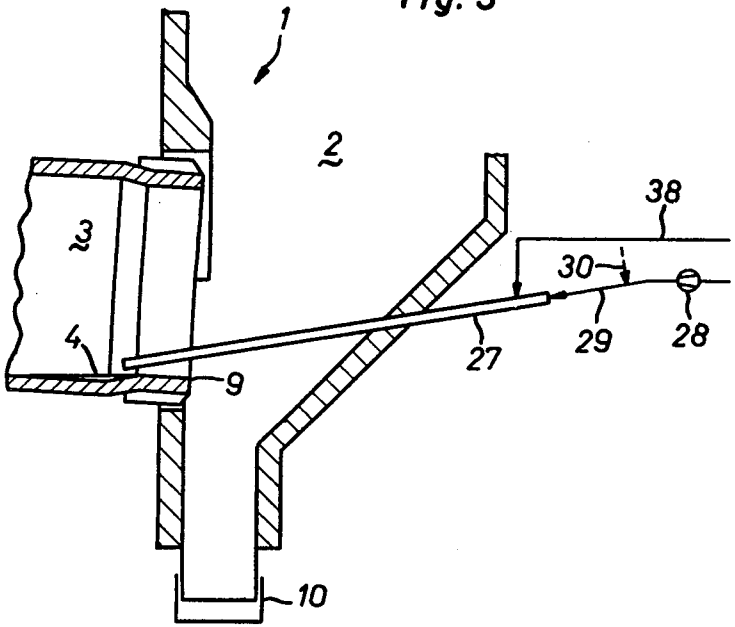
FIG. 3 shows a fragment section of the rear part of the plant of FIG. 1 with a water-cooled charging lance for introducing the fly ash into the slag molten bath of the revolving cylindrical furnace of the plant of FIG. 1 (fourth embodiment).

In a fourth embodiment of the present invention, the fly ash is conveyed by means of a feed mechanism from the hopper 14 of the dust separator 6 to a storage tank. The fly ash removed from the latter is then supplied by means of a proportioning worm in controlled quantities to a water-cooled charging lance 27 via a line 38 (cf. FIG. 3). The fly ash is entrained in the lance 27 by the injector action of an air jet which, as shown in FIG. 3, is fed by means of a blower 28 via an air line 29 into the charging lance 27, which extends in a forward direction and nearly at right angles through the secondary combustion chamber 2. The lance discharges the fly ash at high speed into the molten slag bath 4 of the revolving cylindrical furnace 3. Charging lance 27 is so close to the molten slag bath 4, that most of the fly ash penetrates the bath 4, due to the kinetic energy of its dust particles where it melts. In the case of very fine dust, the dropwise addition of water to the delivery air flow via a line 30 connected to the air line 29 (cf. FIG. 3) can be used to increase the size of the dust particles, thereby increasing kinetic energy by raising the mass moment of inertia of the individual particles. As a result, the penetration depth of the dust particles into molten slag bath 4 is increased. The fly ash is melted in bath 4 and is bound into the molten slag. In the slag bath 4, the molten fly ash-slag mixture again finds an overflow and flows via the rear inner furnace edge 9 into the wet slag removal apparatus 10 (cf. FIG. 1), from where the mixture is discharged from plant 1 in quenched and solidified form.

5th Embodiment

The fifth embodiment of the present invention is shown in FIG. 4. Here, the fly ash is fed from a storage tank filled by means of a feed mechanism from the hopper 14 of the flue gas dust separator 6 (cf. FIG. 1) to a charging lance 27*a* by means of a proportioning worm via line 38, and is entrained by the injector action of an air jet, which, as for the 4th embodiment above, is introduced into charging lance 27*a* at the rear by means of a blower 28 via a line 29. The fly ash is discharged at high speed into an additional fly ash molten bath 31*a*, which is only for fly ash. For this purpose, the secondary combustion chamber 2 of plant 1 is provided with a separate melting chamber 31 for the fly ash. An opening 32 forms with its lower edge an overflow for the fly ash molten bath 31*a*. The molten fly ash falls through shaft 33, into which also falls the molten slag from the revolving cylindrical furnace 3, into the common wet slag removal apparatus 10, from which the quenched solidified slag and fly ash is discharged from the plant by its slag discharge system. The fly ash melting chamber 31 is provided with a burner 34 for an additional fuel, e.g. waste oil or liquid waste fuels, in order to produce the heat necessary for melting the fly ash. It comprises tubular boiler walls 35 which are connected to boiler 5 (cf. FIG. 1). Boiler tubes 35 are provided with a high temperature-resistant plastic refractory material. The combustion gases and delivery air, insofar as the latter does not participate in the combustion of the waste oil or liquid waste fuels, escape from the fly ash melting chamber 31, which is sealed at the top by an ash collecting grate 36, into the secondary combustion chamber 2. As in FIG. 3, a connection 30 for feeding in water in droplet form is provided on delivery air line 29.

The method and/or the plant for practicing the present invention as described hereinbefore relative to five embodiments and the drawings are based on dry flue gas cleaning, e.g. by means of an electrostatic filter. However, the second embodiment according to FIG. 2, in which the separated fly ash is mixed with liquid waste materials or sludge, can also be realized with wet flue gas cleaning, whereby the fly ash sludge obtained in the flue gas scrubber is fed into the storage tank and the following container.

We claim:

1. A method of treating fly ash in a liquid slag discharge waste incinerating system of the type including a revolving cylindrical furnace with charging equipment for solid, pasty, and liquid waste materials as well as sludge, and which at its end has a slag melting bath followed by a secondary combustion chamber and a flue gas dust separator, wherein the improvement comprises the steps of:

separating the fly ash from the flue gases by means of the dust separator;

discharging the separated fly ash, together with the slag, by means of an incinerator slag discharge system;

conveying the separated fly ash initially into a storage tank and from that tank to a combustion chamber with a molten slag bath;

burning in the combustion chamber the combustible constituents still contained in the fly ash;

melting the remaining constituents of the fly ash in the molten slag bath;

solidifying the slag by feeding the molten slag into a wet slag removal system, and removing the solidified slag from the wet removal system.

2. A method according to claim 1, wherein:

the fly ash is removed from the storage tank and introduced into metal containers;

the sealed metal containers are fed into the revolving cylindrical furnace by means of the charging equipment for solid waste material; and, the combustible constituents of the fly ash are completely burned out during the movement thereof through the furnace, after which the fly ash is transformed into a pasty or molten state and only then the metal containers melted by the heat supplied to the latter from the outside in the area of the molten slag bath.

3. A method according to claim 1, wherein:

the fly ash removed from the storage tank is mixed with liquid waste or sludge carried in a closed circuit system via a container and a mixing device, the mixing taking place in the latter;

and part of the mixture formed from the liquid waste or sludge and the fly ash is branched off from the circuit and is fed into the revolving cylindrical furnace by means of a fuel lance for liquid waste or sludge and arranged in the front wall of the furnace.

4. A method according to claim 1, wherein:

the fly ash from the separating is removed in a metered quantity from the storage tank;

by the addition of water and binders the fly ash is pelletized to form a granulate; and, the thus formed pellets are filled into open tanks and are introduced into the revolving cylindrical furnace by means of furnace charging equipment for containers and solid waste material or by means of a charging port provided in the furnace front wall exclusively for charging pellets.

5. A method according to claim 1, wherein:

the fly ash obtained during dry flue gas dust separation is removed from the storage tank in a metered quantity and entrained as a feed medium by an air jet serving as an injector;

the feed medium is blown at high speed against the molten slag bath of the revolving cylindrical furnace;

a large proportion of the fly ash is introduced into the molten slag bath due to the kinetic energy of their dust particles and melted therein; and, the charging lance used for injecting the fly ash is cooled.

6. A method according to claim 1, wherein:

the fly ash obtained during dry flue gas dust separation is fed from the storage tank in metered quantities to a charging lance, and in the latter is conveyed by means of air injection as feed medium into an additional melting chamber arranged in the secondary combustion chamber and is discharged above the molten bath provided in the additional melting chamber;

waste oil or liquid waste fuel is introduced into the additional melting chamber above its molten bath in the direction of the bath surface and is burned; and, due to the heat of combustion, the fly ash introduced into the additional melting chamber is heated and melted, and by means of an overflow opening arranged in the melting chamber wall the molten fly ash is fed from the melting chamber into the wet slag removal system of the plant.

7. A method according to claim 6, wherein water droplets are added to the air injection flow before it enters the charging lance, and as a result the size of the fly ash particles is increased in order to increase their kinetic energy.

8. A method according to claim 1, wherein the fly ash is mixed with mixture of liquid waste materials and/or sludge and is kept in constant motion in the storage tank by a stirring mechanism to prevent the fly ash from being deposited on the bottom of the tank.

9. A method according to claim 1, wherein the combustion product gases and delivered air not used for combustion in the furnace are removed from the furnace into the secondary combustion chamber.

10. A waste incinerator comprising:

a revolving cylindrical furnace having a molten slag bath at its output end;

a charging system for charging the furnace with fuel in the form of solid, pasty, and liquid waste materials and sludge;

a secondary combustion chamber connected to the output of said furnace;

a fly ash separator connected between said secondary combustion chamber and the final output of the flue gases from said incinerator to the atmosphere; and a fly ash conveying mechanism connected to the discharge side of said separator with a fly ash storage tank and at least one charging mechanism which also serves to feed the fly ash into said revolving cylindrical furnace;

wherein said charging system comprises a charging lance for the fly ash, said lance extending into said revolving cylindrical furnace and directed onto the molten bath located therein.

11. A plant according to claim 10, wherein the charging lance is provided with means for introducing water into its air flow.

12. A waste incinerator comprising:

a revolving cylindrical furnace having a molten slag bath at its output end;

a charging system for charging the furnace with fuel in the form of solid, pasty, and liquid waste materials and sludge;

a secondary combustion chamber connected to the output of said furnace;

a fly ash separator connected between said secondary combustion chamber and the final output of the flue gases from said incinerator to the atmosphere; and a fly ash conveying mechanism connected to the discharge side of said separator with a fly ash storage tank and at least one charging mechanism which also serves to feed the fly ash into said revolving cylindrical furnace;

wherein said charging mechanism is a charging lance for the fly ash, said lance extending into an additional melting chamber and directed onto the molten bath located therein.

13. A plant according to claim 12, wherein the charging lance is provided with means for introducing water into its air flow.

14. A waste incinerator comprising:

a revolving cylindrical furnace having a molten slag bath at its output end;

a charging system for charging the furnace with fuel in the form of solid, pasty, and liquid waste materials and sludge;

a secondary combustion chamber connected to the output of said furnace;

a fly ash separator connected between said secondary combustion chamber and the final output of the flue gases from said incinerator to the atmosphere; and a fly ash conveying mechanism connected to the discharge side of said separator with a fly ash storage tank and at least one charging mechanism which also serves to feed the fly ash into said revolving cylindrical furnace;

wherein said charging system for the waste materials is located in the front wall of said revolving cylindrical furnace and has internal cross-sectional dimensions which correspond with the external dimensions of sealed metal containers filled with fly ash to be introduced into said revolving cylindrical furnace.

15. A waste incinerator comprising:

a revolving cylindrical furnace having a molten slag bath at its output end;

a charging system for charging the furnace with fuel in the form of solid, pasty, and liquid waste materials and sludge;

a secondary combustion chamber connected to the output of said furnace;

a fly ash separator connected between said secondary combustion chamber and the final output of the flue gases from said incinerator to the atmosphere;

a fly ash conveying mechanism connected to the discharge side of said separator with a fly ash storage tank and at least one charging mechanism which also serves to feed the fly ash into said revolving cylindrical furnace; and a storage tank connected by means of a delivery mechanism to a container located in a closed circuit for fuel, whereby in said circuit a mixing device is connected in front of said delivery mechanism with a proportioning worm connected to the intake side thereof for proportioning the fly ash to be mixed with fuel, behind said container and in front of said mixing device there being a branch line provided with a regulating valve connected to the circuit line for the mixture, said branch line being connected to a fuel lance incorporated into the front wall of said revolving cylindrical furnace.

16. A waste incinerator comprising:

a revolving cylindrical furnace having a molten slag bath at its output end;

a charging system for charging the furnace with fuel in the form of solid, pasty, and liquid waste materials and sludge;

a secondary combustion chamber connected to the output of said furnace;

a fly ash separator connected between said secondary combustion chamber and the final output of the flue gases from said incinerator to the atmosphere;

a fly ash conveying mechanism connected to the discharge side of said separator with a fly ash storage tank and at least one charging mechanism which also serves to feed the fly ash into said revolving cylindrical furnace; and a pelletizer provided with connections for the supply of water and binders connected to a storage tank for the fly ash via a fly ash metering mechanism, a station being provided for filling the fly ash pellets into open tanks, and a charging means for solid particles which is used for charging the pellets into said furnace.

17. A waste incinerator comprising:

a revolving cylindrical furnace having a molten slag bath at its output end;

a charging system for charging the furnace with fuel in the form of solid, pasty, and liquid waste materials and sludge;

a secondary combustion chamber connected to the output of said furnace;

a fly ash separator connected between said secondary combustion chamber and the final output of the flue gases from said incinerator to the atmosphere;

a fly ash conveying mechanism connected to the discharge side of said separator with a fly ash storage tank and at least one charging mechanism which also serves to feed the fly ash into said revolving cylindrical furnace; and a water-cooled air injection charging lance connected to the storage tank via a fly ash metering mechanism, said lance extending at right angles through said secondary combustion chamber into the rear end of said revolving cylindrical furnace and directed into the molten slag bath therein.

18. A waste incinerator comprising:

a revolving cylindrical furnace having a molten slag bath at its output end;

a charging system for charging the furnace with fuel in the form of solid, pasty, and liquid waste materials and sludge;

a secondary combustion chamber connected to the output of said furnace;

a fly ash separator connected between said secondary combustion chamber and the final output of the flue gases from said incinerator to the atmosphere;

a fly ash conveying mechanism connected to the discharge side of said separator with a fly ash storage tank and at least one charging mechanism which also serves to feed the fly ash into said revolving cylindrical furnace; and an additional fly ash melting chamber in said secondary combustion chamber together with an air injection charging lance connected to said storage tank via a fly ash metering mechanism and installed in the rear wall of said secondary combustion chamber, said lance extending into an additional melting chamber and being directed onto a molten slag bath located on the bottom thereof, said melting chamber being provided with a burner for an additional fuel, said additional melting chamber being located inside the secondary combustion chamber and having an overflow opening for the molten fly ash which issues into a slag removal shaft.

19. A plant according to claim 18, wherein the upper opening of the additional melting chamber is covered by an ash collecting grating connected to a boiler of the plant.

20. A plant according to claim 19, wherein the additional melting chamber is formed by boiler tubes connected to a boiler of the plant and whereby the ash collecting grate is integrated into the boiler tube system.

* * * * *